US007074070B1

(12) United States Patent
Huang et al.

(10) Patent No.: US 7,074,070 B1
(45) Date of Patent: Jul. 11, 2006

(54) CONNECTOR ASSEMBLY WITH LATCH MECHANISM

(75) Inventors: Mao-Jung Huang, Taipei Hsien (TW); Ping-Chih Chen, Taipei Hsien (TW); Te-Hung Yin, Taipei Hsien (TW)

(73) Assignee: Cheng Uei Precision Industry Co., Ltd., Taipei Hsien (TW)

( * ) Notice: Subject to any disclaimer, the term of this patent is extended or adjusted under 35 U.S.C. 154(b) by 0 days.

(21) Appl. No.: 11/156,349

(22) Filed: Jun. 17, 2005

(51) Int. Cl.
*H01R 13/627* (2006.01)

(52) U.S. Cl. ..... 439/352; 439/607; 439/540.1

(58) Field of Classification Search ..... 439/350–364, 439/607–610, 540.1, 108, 501, 315–316, 439/488–489, 266–267, 544, 354, 686, 247
See application file for complete search history.

(56) References Cited

U.S. PATENT DOCUMENTS 5,154,629 A 10/1992 Carver et al.
5,538,437 A * 7/1996 Bates et al. ..... 439/352
5,632,642 A * 5/1997 Briski ..... 439/364
6,095,852 A * 8/2000 Gregory, II ..... 439/540.1
6,146,180 A * 11/2000 Betker et al. ..... 439/352
6,203,354 B1 * 3/2001 Kuwahara et al. ..... 439/357
6,352,447 B1 * 3/2002 Ruth ..... 439/540.1

* cited by examiner

*Primary Examiner*—Truc T. Nguyen
*Assistant Examiner*—Edwin A. Leon

(57) ABSTRACT

A connector assembly includes a plug connector and a receptacle connector. The plug connector includes a dielectric body which has at least two rows of male contact receiving holes extending therethrough and a passageway defined between the two rows of male contact receiving holes. A male latch mechanism is mounted in the passageway. The male latch mechanism has two latch arms and a flexible beam flexibly connecting the latch arms. The receptacle connector has a receiving cavity for receiving the plug connector. A female latch mechanism is positioned in the receiving cavity. The female latch mechanism has an engaging component at its free end for engaging with the latch arms of the male latch mechanism, thereby locking the plug connector to the receptacle connector.

8 Claims, 6 Drawing Sheets

CONNECTOR ASSEMBLY WITH LATCH MECHANISM

BACKGROUND OF THE INVENTION

1. Field of the Invention

This invention generally relates to a connector assembly and, particularly, to a connector assembly including a plug connector and a receptacle connector releasablely engaged with each other.

2. The Related Art

Referring to U.S. Pat. No. 5,154,629 issued on Oct. 13 in 1992, a conventional plug connector disclosed in the patent includes a cable coupled to a connector housing, which is enclosed by a molded outer housing. The outer housing has a pair of side cavities pivotally receiving a pair of latches. The latches have locking fingers for engaging a connecting element and are biased into a locking position by integral leaf springs or helical compression springs. The pivotal coupling of the latches is accomplished by protrusions on the latches retained by recesses in the housing, a pin assembly, or an integrally molded hinge. Correspondingly, a receptacle connector for matching with the plug connector has a pair of hooks disposed at two opposite sides thereof. The latches of the plug connector cooperate with the hooks of the receptacle connector so as to perform the locking function.

However, the latches mentioned above are arranged on two opposite sides of the conventional plug connector, which occupy additional space, thereby increasing the width of the plug connector. Correspondingly, the hooks mentioned above are arranged on two opposite sides of the receptacle connector, which occupy additional space, thereby increasing the width of the receptacle connector. So a connector assembly made up of the plug connector and the receptacle connector certainly has a considerable width.

SUMMARY OF THE INVENTION

A first aspect of the present invention is to provide a connector assembly comprising a plug connector and a receptacle connector. The plug connector includes a dielectric body which has at least two rows of male contact receiving holes extending therethrough and a passageway defined between the two rows of male contact receiving holes. A plurality of male contacts is held in the respective male contact receiving holes. A male latch mechanism is mounted in the passageway. The male latch mechanism has two latch arms and a flexible beam flexibly connecting the two latch arms. Each latch arm has a hook at a front end thereof and a force receiving portion. The receptacle connector includes a dielectric housing which has a receiving cavity and at least two rows of protruding pillars disposed in the receiving cavity, with each pillar defining at least one female contact receiving hole extending therethrough. A plurality of female contacts is held in the respective female contact receiving holes. A female latch mechanism is positioned in the receiving cavity and between the two rows of protruding pillars. The female latch mechanism has an engaging component at the free end thereof. When the plug connector is inserted in the receiving cavity of the receptacle connector and the force receiving portion of the male latch mechanism are exerted by a force, the flexible beam is flexed, whereby the hooks are deflected from their original positions to engage with the engaging component of the female latch mechanism. Thereafter, when the force is removed from the force receiving portions, resilience of the flexible beam urges the hooks to recover their original positions to thereby engage the hooks with the engaging component.

A second aspect of the present invention is to provide a plug connector comprising a dielectric body, a plurality of male contacts and a male latch mechanism. The dielectric body has at least two rows of male contact receiving holes extending therethrough and a passageway defined between the two rows of male contact receiving holes. The plurality of male contacts is held in the respective male contact receiving holes. The male latch mechanism mounted in the passageway includes two latch arms and a flexible beam flexibly connecting the two latch arms. Each latch arm has a hook at a front end thereof and a force receiving portion. When the force receiving portion are exerted by a force, the flexible beam is flexed, whereby the hooks are deflected from their original positions to mate with a mating connector. Thereafter, when the force is removed from the force receiving portions, resilience of the flexible beam urges the hooks to recover their original positions to thereby fasten the mating connector.

A third aspect of the present invention is to provide a receptacle connector comprising a dielectric housing, a plurality of female contacts and a female latch mechanism. The dielectric housing has a receiving cavity in which at least two rows of protruding pillars are disposed. Each pillar defines at least one female contact receiving hole therethrough. The plurality of female contacts is held in the respective female contact receiving holes. The female latch mechanism is positioned in the receiving cavity and between the two rows of protruding pillars. The female latch mechanism has an engaging component at the free end thereof.

In the connector assembly mentioned above, the male latch mechanism is assembled in inner space of the plug connector, and the female latch mechanism is assembled in inner space of the receptacle connector. Consequently, both the plug connector and the receptacle connector of the present invention can respectively make the most of their inner space to achieve a compact width. Similarly, the connector assembly made up of the plug connector and the receptacle connector certainly has a compact width.

BRIEF DESCRIPTION OF THE DRAWINGS

A detailed explanation of a preferred embodiment of the present invention will be given, with reference to the attached drawings, for better understanding thereof to those skilled in the art.

DETAILED DESCRIPTION OF THE PREFERRED EMBODIMENT

Figure 1:
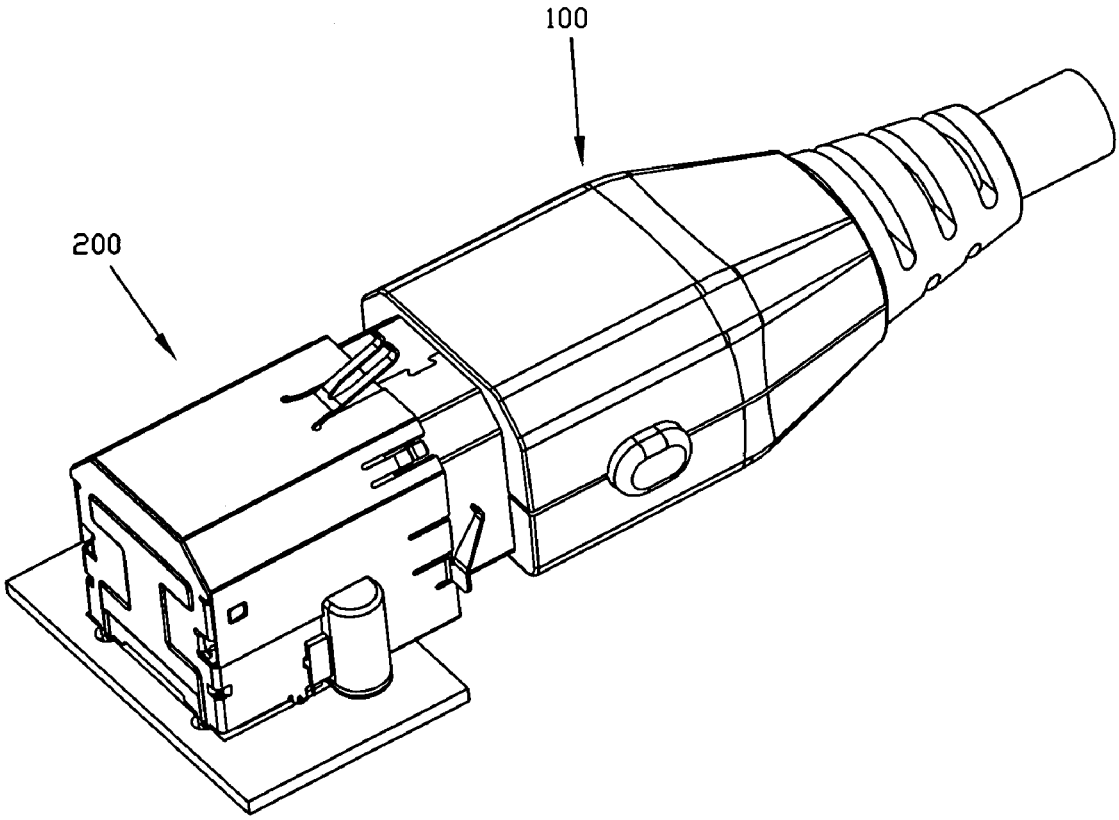
FIG. 1 is a perspective view of a connector assembly in accordance with the present invention.

Referring to FIG. 1, a connector assembly according to the present invention includes a plug connector 100 and a receptacle connector 200 for mating with the plug connector 100. The plug connector 100 and the receptacle connector 200 will be respectively described in detail hereinafter.

Figure 2:
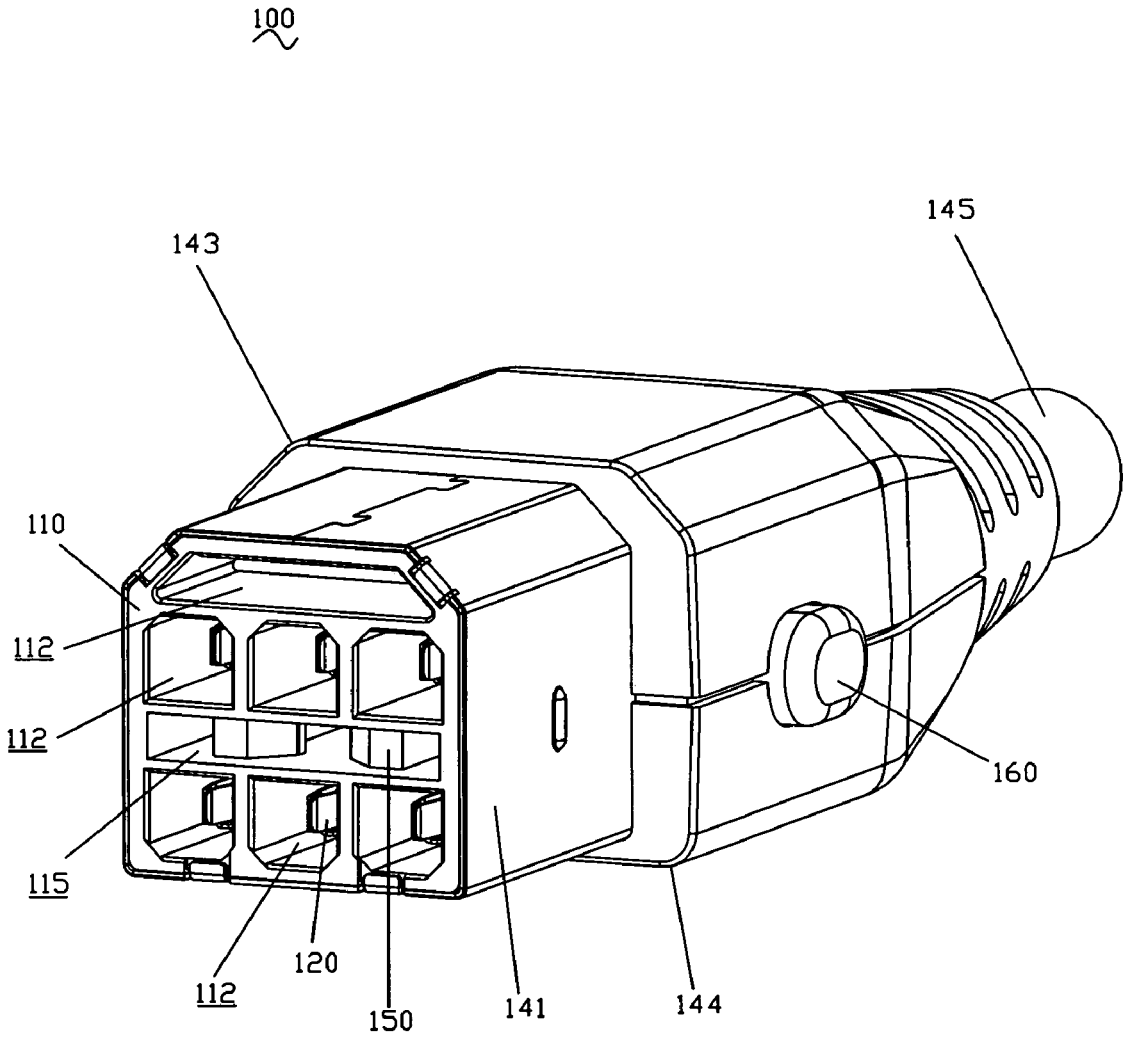
FIG. 2 is a perspective view of a plug connector of the connector assembly in accordance with the present invention.
Figure 3:
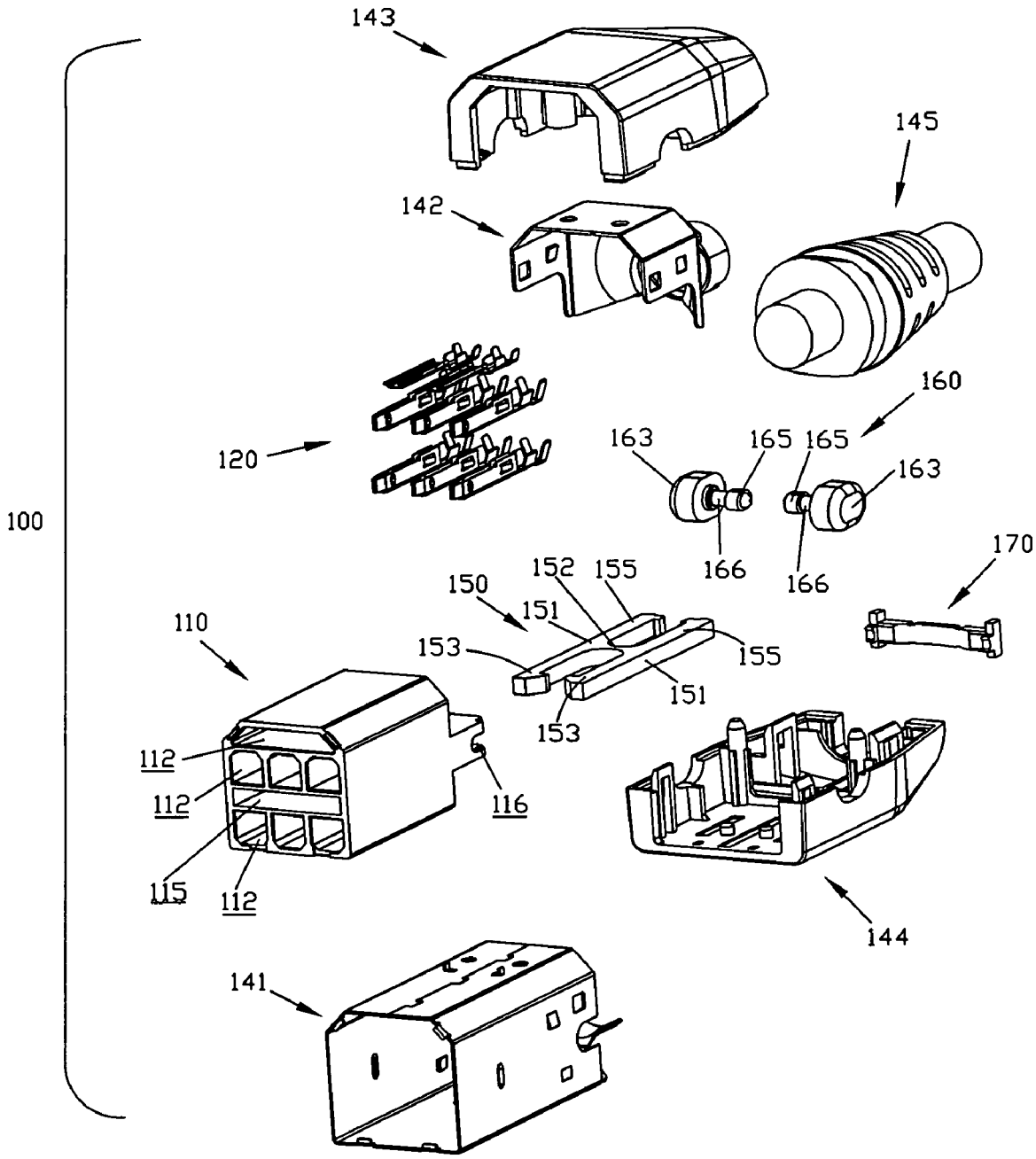
FIG. 3 is an exploded view of the plug connector shown in FIG. 2.

With reference to FIGS. 2 and 3, the plug connector 100 in accordance with the present invention comprises a dielectric body 110, a plurality of male contacts 120 held in the dielectric body 110, a primary metal shield 141 and a secondary metal shield 142 encircling the dielectric body 110, an upper dielectric cover 143 and a lower dielectric cover 144 clasping a rear portion of the dielectric body 110 therebetween, and a male latch mechanism 150 mounted in the dielectric body 110. A front portion of the dielectric body 110 is exposed out from the covers as a mating portion for mating with the receptacle connector 200. A cable 145 extends into inside of the connector 100 and has a plurality of conductive leads (not shown) respectively connecting with the male contacts 120.

Figure 6:
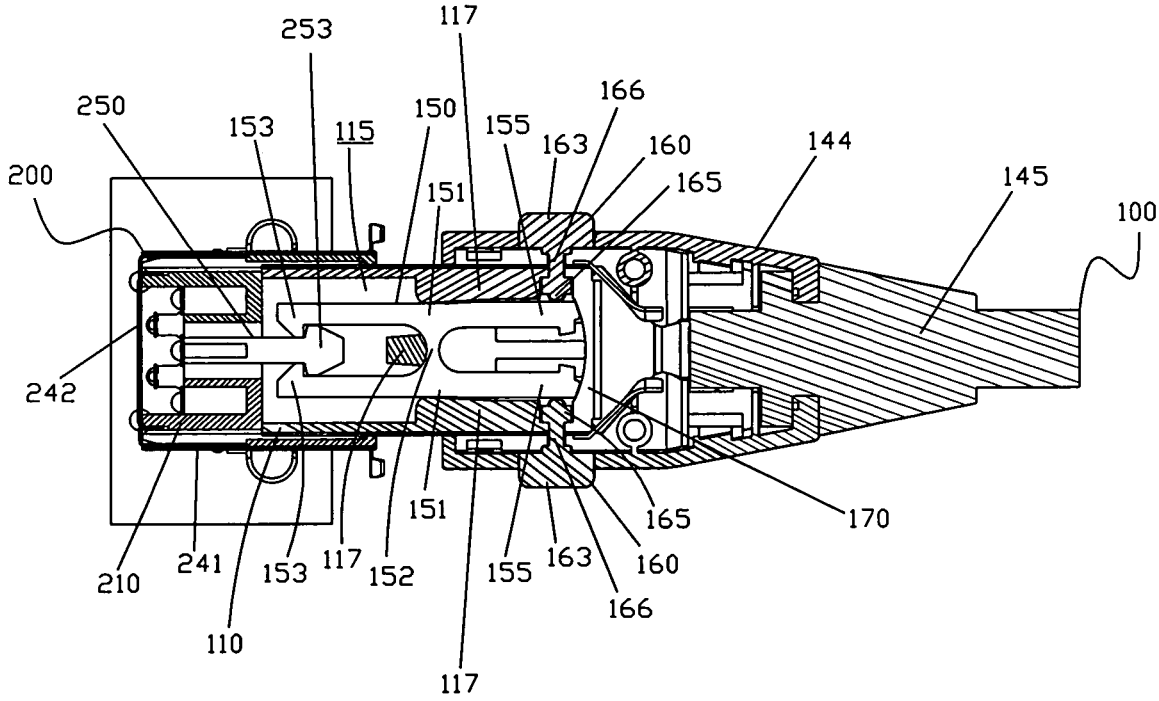
FIG. 6 is a cross-sectional view of the connector assembly.

As shown in FIG. 3, the dielectric body 110 defines a plurality of male contact receiving holes 112 and a passageway 115 therein, which all extend through the dielectric body 110 front to rear. The male contact receiving holes 112 are arranged in three (upper, middle and lower) rows for correspondingly holding three (upper, middle and lower) rows of male contacts 120 therein. The passageway 115 is located between the middle row and the lower row of the male contact receiving holes 112, which is used for receiving the latch mechanism 150 therein. As shown in FIG. 6, the dielectric body 110 forms three protrusions 117 in the passageway 115 for positioning the male latch mechanism 150. The dielectric body 110 further includes two recesses 116 which are respectively defined in two opposite side walls of the dielectric body 110. Each of the recesses 116 laterally communicates the passageway 115 with outside, and each of the recesses 116 opens to rear.

The male latch mechanism 150 shown in FIG. 3 is fabricated of a unitarily single component of dielectric material, such as plastic or the like. The male latch mechanism includes two latch arms 151 and a flexible beam 152 flexibly connecting middle portions of the two latch arms 151. The front end of each latch arm 151 protrudes inwardly to form a hook 153. A portion of each latch arm 151 behind the flexible beam 152 acts as a force receiving portion, designated 155. The flexible beam 152 can be forced to flex when a force acts on the force receiving portions 155, and can recover to its original state itself when the force is removed from the force receiving portions 155.

The male latch mechanism 150 is used for releasably locking with the receptacle connector 200. When an external force is exerted on the two force receiving portions 155 to move the force receiving portions 155 inwardly, the flexible beam 152 is flexed, and the two hooks 153 are deflected apart from their original position. Thereafter, when the external force is removed from the force receiving portions 155, resilience of the flexible beam 152 urges the hooks 153 to recover their original position to thereby fasten the receptacle connector 200.

Referring to FIG. 3, the plug connector 100 further includes a pair of buttons 160. Each of the buttons has a pressing head 163, a pushing foot 165, and a propping neck 166 connecting the pressing head 163 and the pushing foot 165 together.

Referring to FIG. 3 again, the plug connector 100 further includes a stopper 170. The stopper 170 shaped as a strip is used for sealing the end of the passageway 115 and the rear opening of the recesses 116.

Please refer to FIGS. 2 and 3 in conjunction with FIG. 6, in assembling of the electrical connector 100, firstly the male contacts 120 are inserted into the dielectric body 110 and held in the male contact receiving holes 112. Then the male latch mechanism 150 is mounted in the passageway 115 of the dielectric body 110 and positioned by the protrusions 117 so as to keep the male latch mechanism 150 as an integrated element from onward, rightward and leftward movement relative to dielectric body 110. Thereafter, the propping neck 166 of each button 160 is retained in the corresponding recess 116 with the pressing head 163 exposed to outside of the dielectric body 110 and the pushing foot 165 extending into in the passageway 115 for touching with the force receiving portion 155 of the male latch mechanism 150. The stopper 170 is infixed into the end of the passageway 115 and seals the rear opening of each recess 116 so as to keep the latch arms 151 of the male latch mechanism 150 and the buttons 160 from rearward movement. Finally, the dielectric body 110 is covered by the primary metal shield 141 and the secondary metal shield 142 and clasped by the upper dielectric cover 143 and the lower dielectric cover 144.

In the plug connector 100 according to the present invention, the buttons 160 are used to cooperate with the male latch mechanism 150 for transmitting an external force acted on the pressing heads 163 to the force receiving portions 155 of the male latch mechanism 150 by the pushing feet 165 touching with the force receiving portions 155. As using, when the pressing heads 163 are pressed, the pressing force is transmitted to the force receiving portions 155, thereby the two hooks 153 are deflected from their original positions to mate with the receptacle connector 200. When the external force is removed from the pressing heads 163 of the buttons 160, the hooks 153 urged by the resilience of the flexible beam 152 tend to recover to the original positions to thereby fasten the receptacle connector 200.

It can be seen from the mentioned above that, the male latch mechanism 150 is assembled in inner space of the plug connector 100 to make the most of the inner space of the plug connector 100, thereby the plug connector 100 achieves a compact width.

Figure 4:
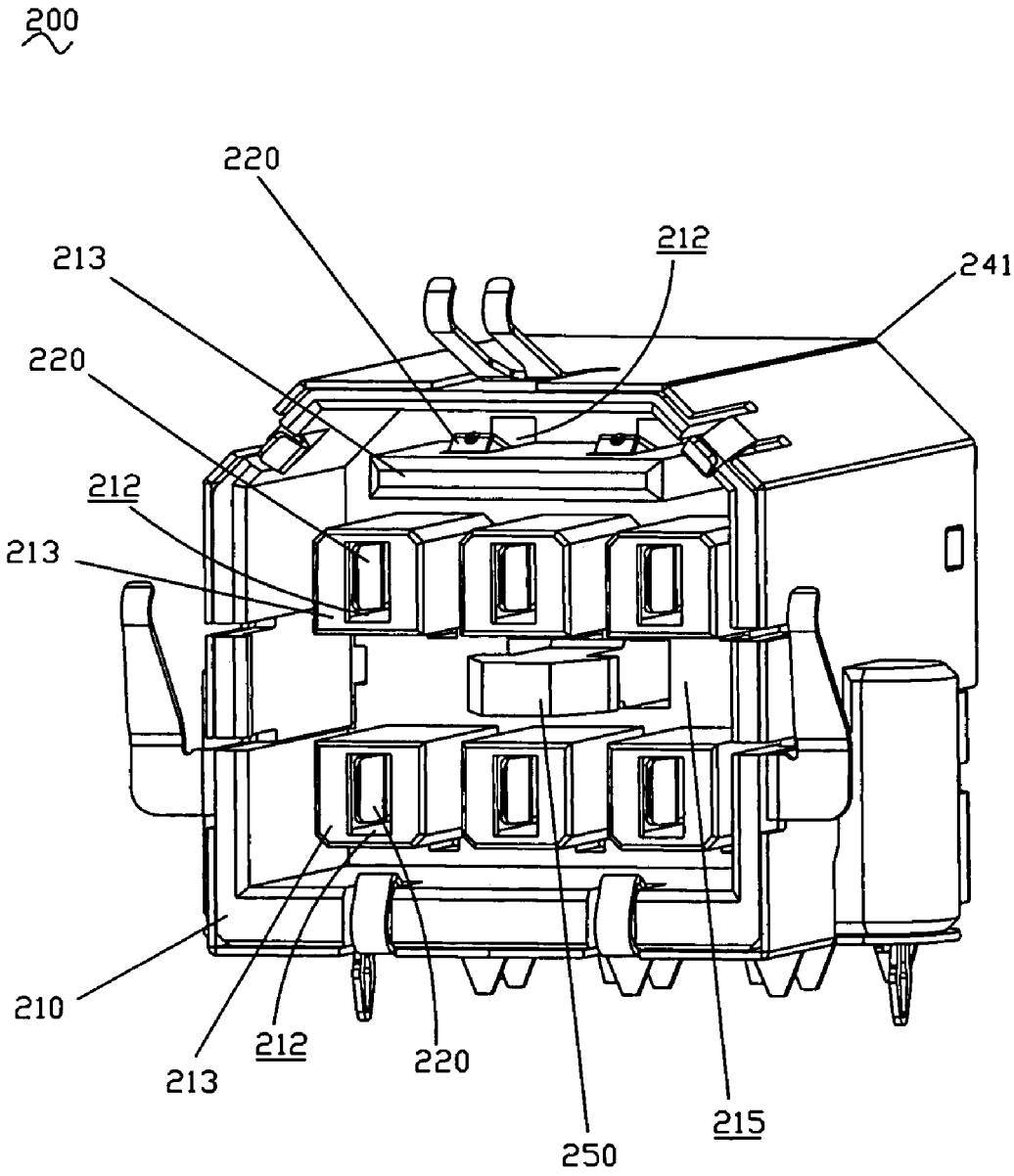
FIG. 4 is a perspective view of a receptacle connector of the connector assembly in accordance with the present invention.
Figure 5:
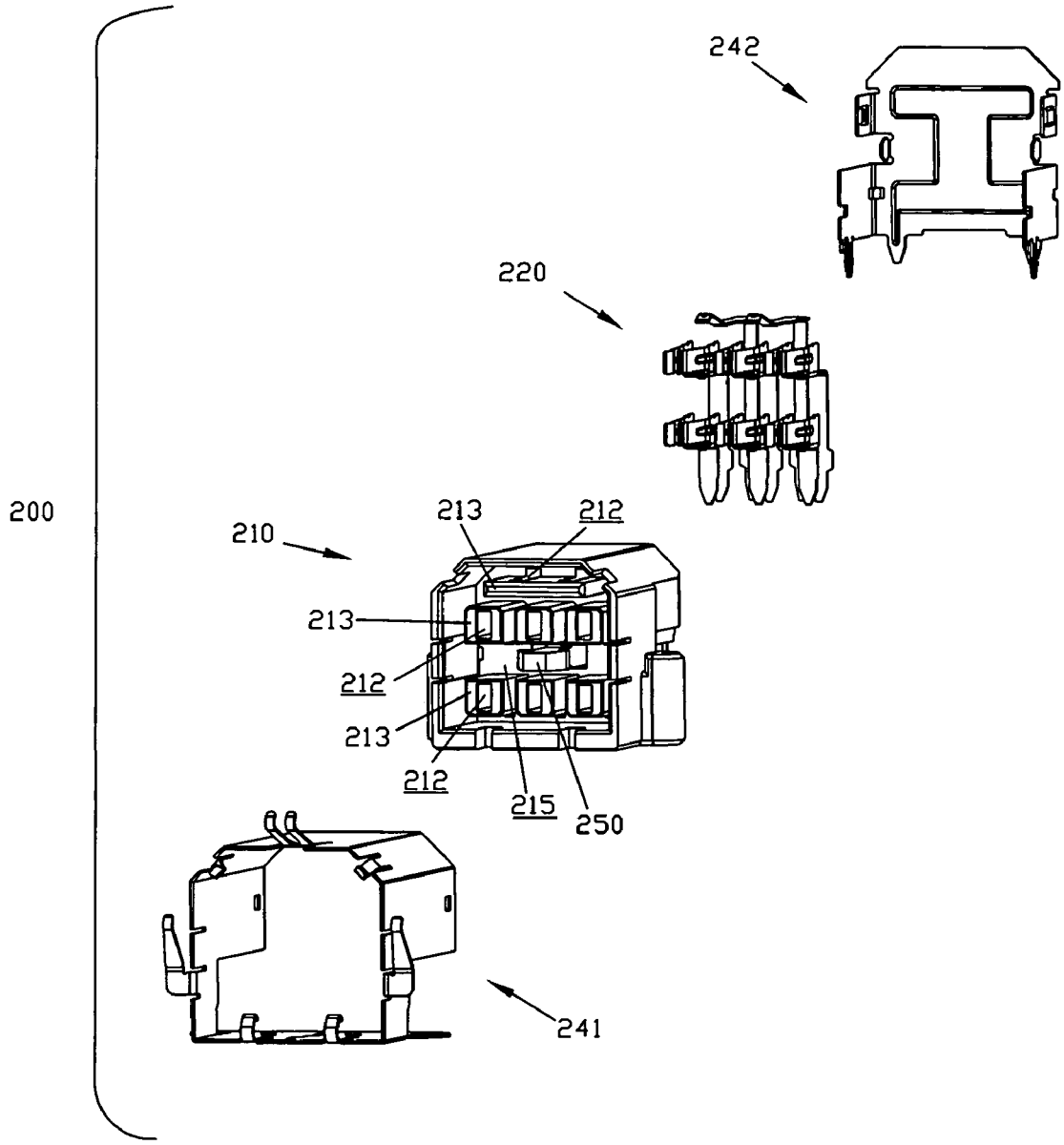
FIG. 5 is an exploded view of the receptacle connector shown in FIG. 4.

With reference to FIGS. 4 and 5, a receptacle connector 200 for matching with the plug connector 100 mentioned above is provided according to the present invention. The receptacle connector 200 comprises a dielectric housing 210, a plurality of female contacts 220 disposed in the dielectric housing 210, and a first and second metal shields 241, 242 encircling the dielectric housing 210.

As shown in FIG. 5, the receptacle connector 200 defines a receiving cavity 215 in the dielectric housing 210, which has a front opening for receiving the plug connector 100. When the plug connector 100 is fully mated with the receptacle connector 200, the mating portion of the plug connector 100 mentioned above is received in the receiving cavity 215.

In order to correspond to the arrangement of the male contact receiving holes 112 defined in the plug connector 100, similarly, a plurality of protruding pillars 213 are arranged in three (upper, middle and lower) rows in the dielectric housing 210 each having a rear end joined to the dielectric housing 210 and a free end extending into the receiving cavity 215. These three rows of protruding pillars 213 define three rows of female contact receiving holes 212 therethrough, and these three rows of female contact receiving holes 212 are used for holding three rows of female contacts 220 therein.

In order to correspond to the arrangement of the male latch mechanism 150 mounted in the plug connector 100, a female latch mechanism 250 is positioned in the receiving cavity 215 and between the middle row and the lower row of protruding pillars 213. The female latch mechanism 250 is integrally formed with the dielectric housing 210 with its free end extending into the receiving cavity 215 and protruding outwardly to form an engaging component 253.

Referring to FIGS. 4 and 5 again, in assembling of the receptacle connector 200, firstly, the female contacts 220 are inserted into the dielectric housing 210 and held in the corresponding female contact receiving holes 212. Thereafter, the dielectric housing 210 is encircled by the first metal shield 24 land the second metal shield 242.

It can be seen from the mentioned above that, the female latch mechanism 250 is assembled in inner space of the receptacle connector 200 to make the most of the inner space of the receptacle connector 200, thereby the receptacle connector 200 achieves a compact width.

With reference to FIG. 6, in mating of the plug connector 100 and the receptacle connector 200, the buttons 160 are pressed firstly, which drives the male latch mechanism 150 to convert its original state into a preparation state for mating with the receptacle connector 200. Then, with the buttons 160 being pressed and the male latch mechanism 150 being in the preparation state, the mating portion of the plug connector 100 is inserted into the receiving cavity 215 of the receptacle connector 200. At this moment, the protruding pillars 213 are respectively inserted in the corresponding male contact receiving holes 212, and the hooks 153 of two latch arms 151 are about to engage with the engaging component 253 of the female latch mechanism 250. Thereafter, when the force is removed from the buttons 160, the hooks 153 urged by the resilience of the flexible beam 152 tend to recover their original positions. Thus the hooks 153 engage with the engaging component 253, thereby locking the plug connector 100 to the receptacle connector 200.

Although preferred embodiment of the present invention have been described in detail hereinabove, it should be clearly understand that many variations and/or modifications of the basic inventive concepts herein taught which may appear to those skilled in the present art will fall within the spirit and scope of the present invention, as defined in the appended claims.

What is claimed is:

1. A connector assembly comprising:

a plug connector including a dielectric body which has at least two rows of male contact receiving holes extending therethrough and a passageway defined between the two rows of male contact receiving holes, a plurality of male contacts held in the respective male contact receiving holes, and a male latch mechanism mounted in said passageway; and a receptacle connector including a dielectric housing which has a receiving cavity and at least two rows of protruding pillars disposed in the receiving cavity, with each pillar defining at least one female contact receiving hole extending therethrough, a plurality of female contacts held in the respective female contact receiving holes, and a female latch mechanism positioned in the receiving cavity and between said two rows of protruding pillars;

wherein the male latch mechanism has two latch arms and a flexible beam flexibly connecting the two latch arms, each latch arm having a hook at a front end thereof and a force receiving portion;

wherein the female latch mechanism has an engaging component at the free end thereof;

wherein when the plug connector is inserted in the receiving cavity of the receptacle connector and the force receiving portion of the male latch mechanism are exerted by a force, the flexible beam is flexed, whereby the hooks are deflected from their original positions to engage with the engaging component of the female latch mechanism, thereafter, when the force is removed from the force receiving portions, resilience of the flexible beam urges the hooks to recover their original positions to thereby engages the hooks with the engaging component.

2. The connector assembly as claimed in claim 1, wherein the hooks of said two latch arms protrudes inwardly, and the engaging component of said female latch mechanism protrudes outwardly.

3. The connector assembly as claimed in claim 1, wherein the female latch mechanism is integrally form with the dielectric housing.

4. A plug connector comprising:

a dielectric body having at least two rows of male contact receiving holes extending therethrough and a passageway defined between the two rows of male contact receiving holes;

a plurality of male contacts held in the respective male contact receiving holes; and a male latch mechanism mounted in said passageway, including two latch arms and a flexible beam flexibly connecting the two latch arms, each latch arm having a hook at a front end thereof and a force receiving portion;

wherein when the force receiving portion are exerted by a force, the flexible beam is flexed, whereby the hooks are deflected from their original positions to mate with a mating connector, thereafter, when the force is removed from the force receiving portions, resilience of the flexible beam urges the hooks to recover their original positions to thereby fasten the mating connector.

5. The plug connector as claimed in claim 4, further including a primary metal shield and a secondary metal shield encircling the dielectric body.

6. The plug connector as claimed in claim 4, further including an upper dielectric cover and a lower dielectric cover clasping the dielectric body therebetween.

7. The plug connector as claimed in claim 4, wherein the dielectric body defines two recesses in opposite sides thereof communicating with the passageway, the plug connector further includes two buttons mounted on the dielectric body, each button has a pressing head exposed to outside of said dielectric body, a pushing foot extending into the passageway for touching with the corresponding force receiving portion of the latch arm, and a propping neck retained in the corresponding recess, the force is exerted on the force receiving portion by pressing the pressing head.

8. The plug connector as claimed in claim 7, further including a stopper infixed in the end of said passageway and seals the rear opening of each said recess for retaining said latch arms and said buttons.

* * * * *